US007594315B2

(12) United States Patent
Montena

(10) Patent No.: US 7,594,315 B2
(45) **Date of Patent: *Sep. 29, 2009**

(54) COMPRESSION TOOL WITH ADJUSTABLE DRIVING PIN

(75) Inventor: Noah P. Montena, Syracuse, NY (US)

(73) Assignee: John Mezzalingua Associates, Inc., E. Syracuse, NY (US)

( * ) Notice: Subject to any disclaimer, the term of this patent is extended or adjusted under 35 U.S.C. 154(b) by 170 days.

This patent is subject to a terminal disclaimer.

(21) Appl. No.: 11/401,550

(22) Filed: Apr. 11, 2006

(65) Prior Publication Data

US 2007/0234556 A1 Oct. 11, 2007

(51) Int. Cl.
*H01R 43/042* (2006.01)
*H01R 43/02* (2006.01)

(52) U.S. Cl. ..... 29/751; 29/748; 29/750; 29/758; 29/861; 29/882; 72/400.01; 72/400.06

(58) Field of Classification Search ..... 29/566.4, 29/751, 758, 748, 750, 861, 862; 72/409.01, 72/409.06, 400.01, 400.06
See application file for complete search history.

(56) References Cited

U.S. PATENT DOCUMENTS

| | | | | |
|---|---|---|---|---|
| 3,074,155 | A * | 1/1963 | Hahn et al. | 29/739 |
| 3,199,334 | A * | 8/1965 | Holmes et al. | 72/409.01 |
| 3,199,335 | A * | 8/1965 | Holmes et al. | 72/409.01 |
| 3,738,150 | A * | 6/1973 | Holmes et al. | 72/409.16 |
| 5,392,508 | A | 2/1995 | Holliday et al. | |
| 5,500,998 | A * | 3/1996 | Schmode et al. | 29/751 |
| 5,647,119 | A | 7/1997 | Bourbeau et al. | |
| 6,293,004 | B1 * | 9/2001 | Holliday | 29/751 |
| 6,594,888 | B2 * | 7/2003 | Chang | 29/751 |
| 7,055,361 | B2 * | 6/2006 | Hetland et al. | 72/409.06 |
| 7,120,997 | B2 * | 10/2006 | Islam et al. | 29/751 |
| 7,188,507 | B2 * | 3/2007 | Holliday et al. | 72/409.14 |
| 7,299,542 | B2 * | 11/2007 | Montena | 29/751 |
| 7,299,543 | B2 * | 11/2007 | Montena | 29/751 |

* cited by examiner

*Primary Examiner*—Carl J Arbes
(74) *Attorney, Agent, or Firm*—Schmeiser, Olsen & Watts

(57) ABSTRACT

A compression tool having a pin assembly with at least two driver pins attached to allow compression of different sized connectors onto wires. The driver pins are attached to prevent loss of equipment use due to misplaced or loose connectors.

17 Claims, 10 Drawing Sheets

COMPRESSION TOOL WITH ADJUSTABLE DRIVING PIN

CROSS-REFERENCE TO RELATED APPLICATIONS

This application is related to U.S. patent application Ser. No. 11/371,112, filed on 8 Mar. 2006, entitled compression tool with rotating, multiple cable cradle, the contents of which is incorporated in its entirety.

FIELD OF THE INVENTION

The invention is in the field of compression tools used for compressing connector ends onto wire or cable for the production of connector cables.

BACKGROUND

The electronics, telecommunications, and cable television industries have used a variety of cables and wires to perform various jobs. The cables tend to be jacketed and shielded to minimize signal distortion. Each cable or wire has various size and shaped connectors based upon either an industry standard or in some cases a proprietary manufacturing standard. The industry has used compression tools to attach various size and types of connectors onto wires. Many known compression tools utilize a universal compression head in combination with an appropriate adapter to attach a connector of a specific length, diameter or other dimension.

This type of compression tool with an adjustable adapter to vary connector size is compact because it is designed to fit only one connector at a time. This is great for ease of handling and storage of the tool unless the spare pins are kept within the tool, which can result in bulkiness. Initially, in the early stages of a universal compression tool's life span the tool works as intended, but there are many drawbacks as the tool ages. One drawback is that the adapters can be lost or damaged. Another drawback is that depending on the design the additional moving parts create wear, looseness of the insert and eventual failure of the compression tool. The instant invention addresses the abovementioned drawbacks of the universal connector compression tool.

SUMMARY OF THE INVENTION

A first embodiment of an adjustable or multiple drive pin size compression tool comprises a body having an interior; a handle, wherein the handle is movably attached to the body; at least one compression chamber portion within the interior of the body that is configured for receiving a connector; a cable cradle having at least one cable receiving portion, wherein the cable cradle is affixed to the body; an driver pin assembly having at least two driver pins operatively coupled to the handle wherein said assembly has a first driver pin position and a second driver pin position; and at least two different dimensioned driver pins affixed to the driver pin assembly.

In another embodiment a multiple driver tip compression tool comprises a body having an interior, a top, a bottom, a first side and a second side each side having a guidance portion therein; a handle, wherein the handle is pivotally attached to the body between the first side and the second side; a sliding head having a guidance component, wherein the guidance component of the sliding head is both retained and movable within the retainer portion of the body; a toggle lever affixed to the handle; a driver pin assembly having at least two differently dimensioned driver pins operatively coupled to the sliding head wherein said assembly has a first driver pin position and a second driver pin position; an compression channel portion configured to receive a first connector when the driver pin assembly is in the first driver pin position, and a second connector when the driver pin assembly is in the second driver pin position; and, a cable cradle, wherein the cradle is affixed to the body between the first side and the second side.

Another embodiment is a method of affixing a cable connector to a wire comprising: providing a body having an interior, a handle, wherein the handle is movably attached to the body, at least one compression chamber portion within the interior of the body that is configured for receiving a connector, a cable cradle having at least one cable receiving portion, wherein the cable cradle is affixed to the body, an driver pin assembly having at least two driver pins operatively coupled to the handle wherein said assembly has a first driver pin position and a second driver pin position, and at least two different dimensioned driver pins affixed to the driver pin assembly; providing a cable connector; providing a wire; inserting the cable connector and the wire and selecting an appropriately sized driver tip in the body that corresponds to the driver tip position; rotating the driver pin assembly to the appropriate driver tip position; moving the sliding head to drive the cable connector onto the wire forming a connector cable; and, removing the connector cable from the body.

A still further embodiment is a multi-pin compression tool comprising: a body; a driver pin assembly having a means of adjusting driver pin size within the body; and a means of moving the driver pin from an uncompressed position to a compressed position.

DETAILED DESCRIPTION OF THE INVENTION

Figure 1:
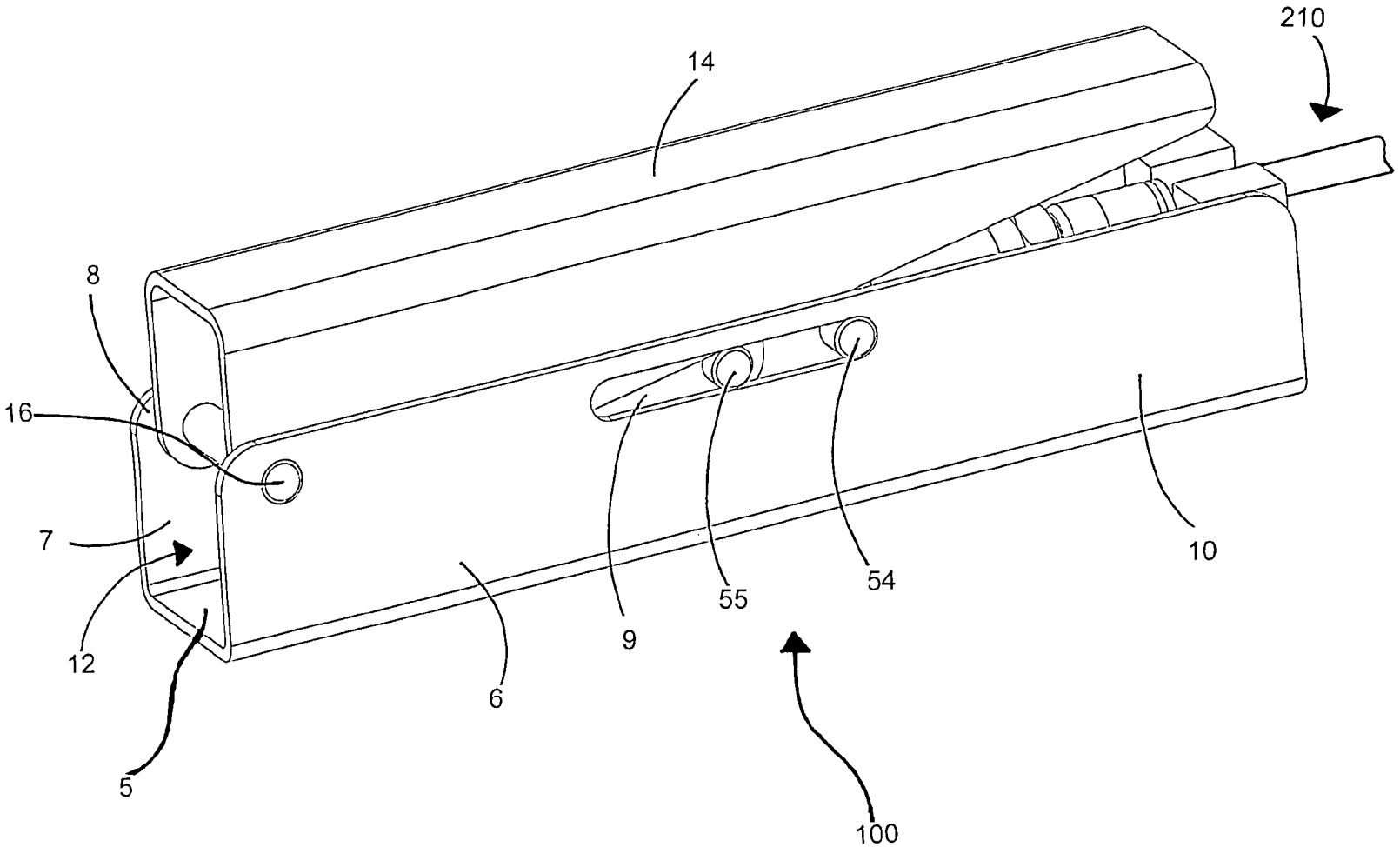
FIG. 1 shows a side view of the tool.

The tool addresses the prior art problems associated with looseness or loss of drivers pins by having a pin assembly in the tool having different size driver pins attached. A multiple drive pin size compression tool 100 as shown in FIGS. 1-10 comprises a body 10 having an interior 12. The body is a rigid material such as a metal or plastic that would be of sufficient torsional rigidity to not flex during the compression of the connector 200 onto the wire 210. The body 10 could be stamped metal or injection molded plastic.

To provide the force to compress the connector 200 on the wire 210 a handle as shown in FIG. 1, wherein the handle 14 is movably attached to the body 10. The handle 14 may be made of the same material as the body as long as it is formed of sufficiently rigid enough material, such that it does not flex during the compression of the connector. The handle 14 or any other possible means of moving the driver pin from an uncompressed position to a compressed position, may be affixed pivotally or hinged 16 between the handle 14 to the body 10 or moveably attached to the body 10 by rivets, screws, bolts, hinges or any other mechanism that would allow the handle to move from a first position to a second position a sufficient distance to generate the force required to compress the connector 200 onto the wire 210. Examples of a means of moving the driver pin from an uncompressed position to a compressed position are hydraulic pistons, any form of levers or screw mechanism.

Figure 3:
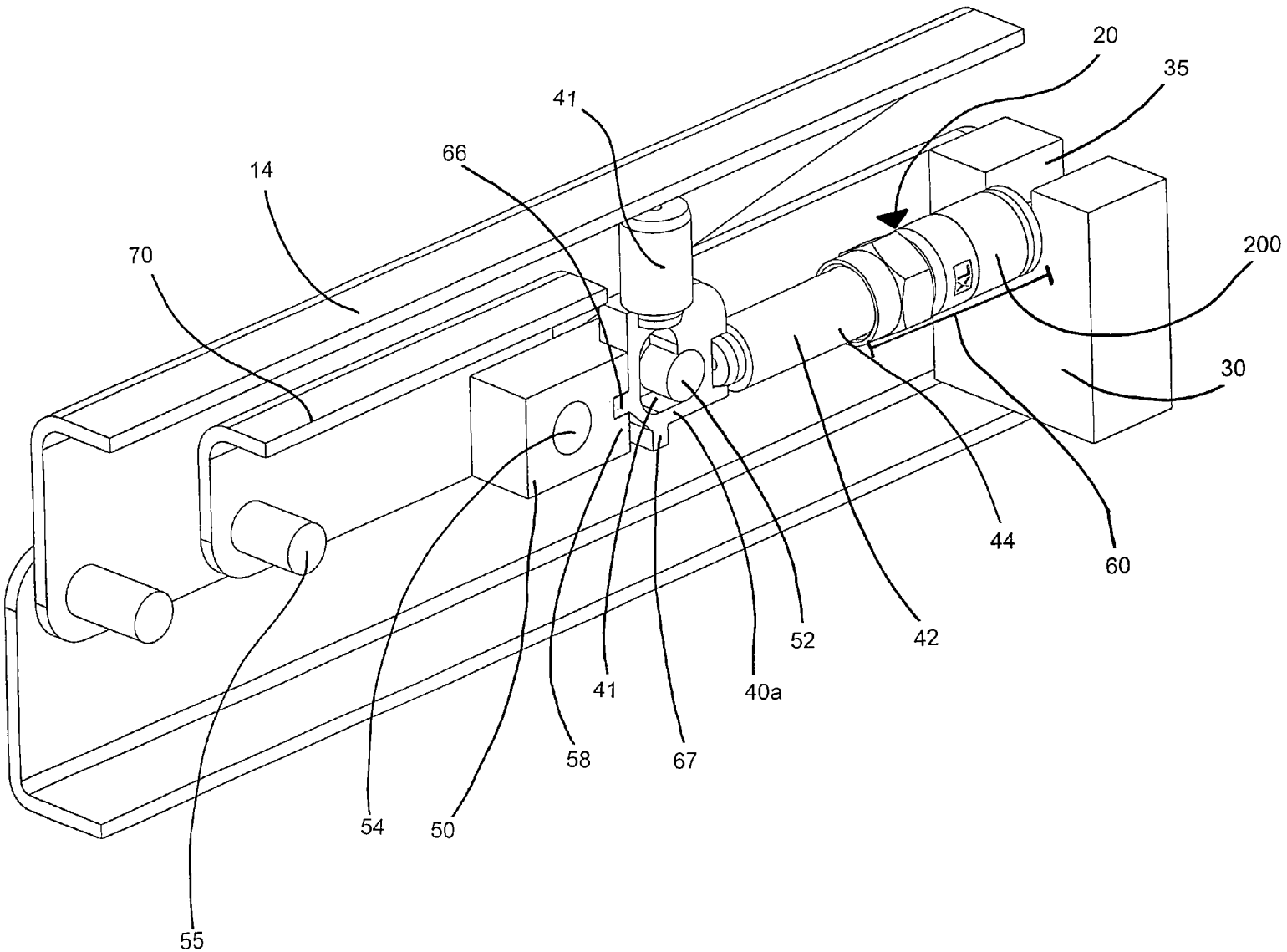
FIG. 3 shows the cross sectional view of the tool with a connector compressed onto a cable.

The body 10 of the tool 100 forms at least one compression chamber portion 20 within the interior 12 of the body 10 that is configured for receiving a connector 200. FIG. 3 shows the connector 200 in the compression chamber 20 when in the fully compressed position. At one end of the compression chamber 20 is a cable cradle 30 having at least one cable receiving portion 35, wherein the cable cradle 30 is affixed to the body 10 so as to receive and align the connector within the compression chamber 20.

At the other end of the compression chamber 20 is a driver pin assembly 40 having at least two driver pins 41, 42 operatively coupled to the handle 14, either directly or through other elements, such as a toggle lever 70 affixed between the handle 14 and the sliding head 50. The assembly has a first driver pin position 44 and a second driver pin position 45 selected according to the connector 200 compressed. FIG. 3 shows the driver pin assembly 40 in the first driver pin position 44, wherein driver pin 42 is positioned next to the compression chamber 20 and there is at least two different dimensioned driver pins 41, 42 affixed to the driver pin assembly The driver pin assembly 40 may be coupled to a sliding head 50 having a protruding component 52, such as a pin or dowel that is configured to interact with the driver pin assembly 40 and the handle 14. A receiving portion 41 within the driver pin assembly 40 accepts the protruding component 52 of the sliding head 50. The receiving portion 41 may be an "L-shaped" groove or any other shaped channel that allows the driver pin assembly 40 to be guided from the first pin position 44 to the second pin position 45, for example a star, a circle or a straight section. The protruding component and the receiving portions could be swapped onto the opposite components as long as the movement between the driver pins is retained.

As displayed in FIG. 3, the full compression of the connector 200 onto the wire 210 is important and the choice of driver pin is defined by its compressed length. If the compressed length is too long or too short for the connector 200 it will either become damaged or fail to be fully compressed and may fail early. Thus the driver pin assembly 40 is moved to the first pin position 44 where it forms a first compressed length 60, which is defined by the distance from the cable cradle 30 to the driver pin assembly 40 When, as displayed in FIG. 7, a second compressed length 61 is needed, the driver pin assembly 40 may be moved to the second driver pin position 45 or swapped with a different pin assembly.

The driver pin assembly 40 has protrusions or tabs 66, 67 that interact with the sliding head 50 to lock the driver pin assembly 40 in the proper position to compress the connector 200 onto a wire 210. The driver pin assembly 40 has a first driver pin locking tab 66 associated with the first driver pin position 44 and a tab receiver 58 on the sliding head 50. The tab receiver 58 may be a groove, notch or corresponding feature, either male or female that interlocks with the locking tabs 66, 67 of the driver pin assembly 40. Other forms of reverse-able or release-able mechanical interlocking that may be envisioned is possible such that any male/female combinations would suffice as long as the pin remained releseably secured.

Figure 8:
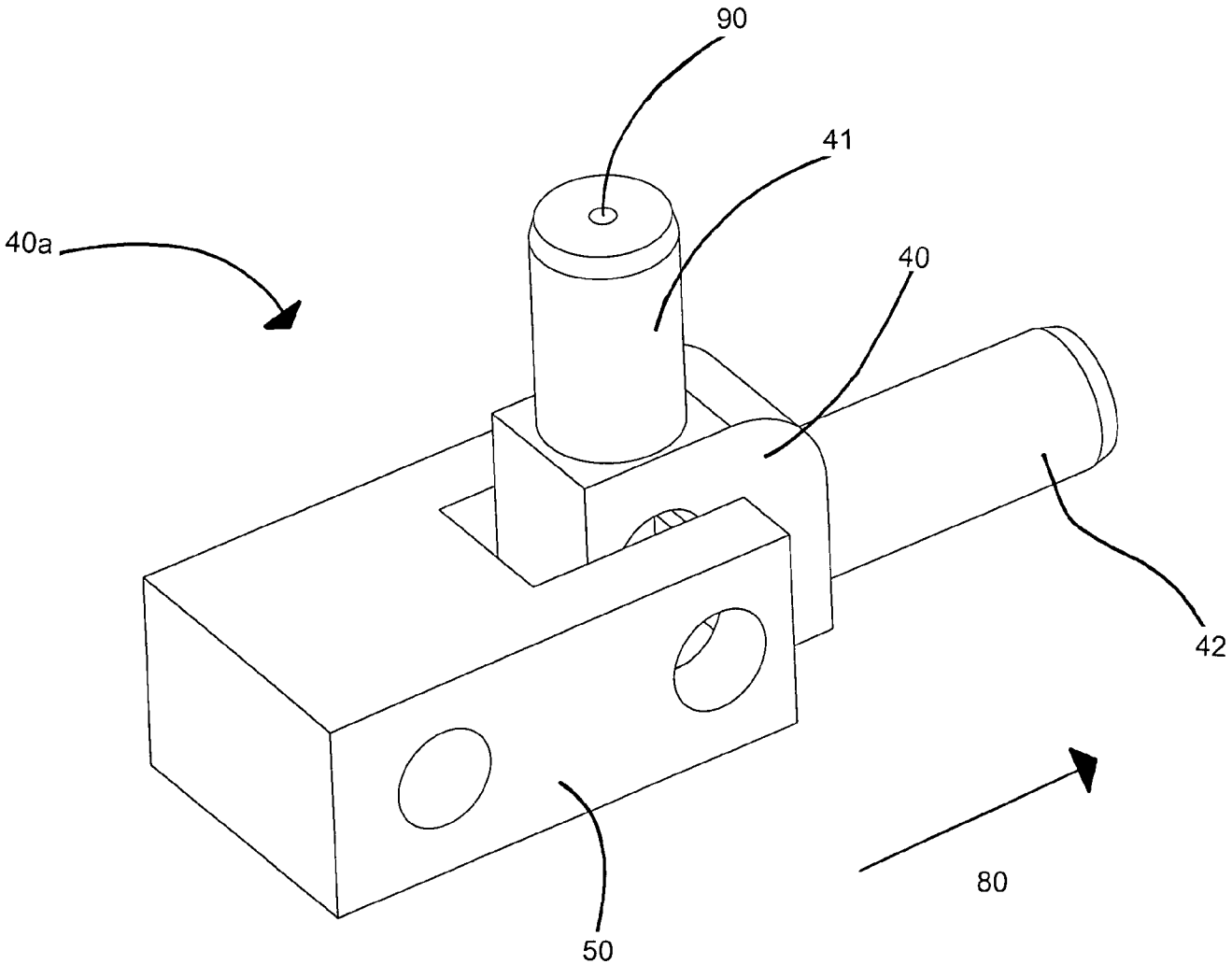
FIG. 8 shows an external view of the driver pin moved to the unlocked position when removed from the tool.
Figure 9:
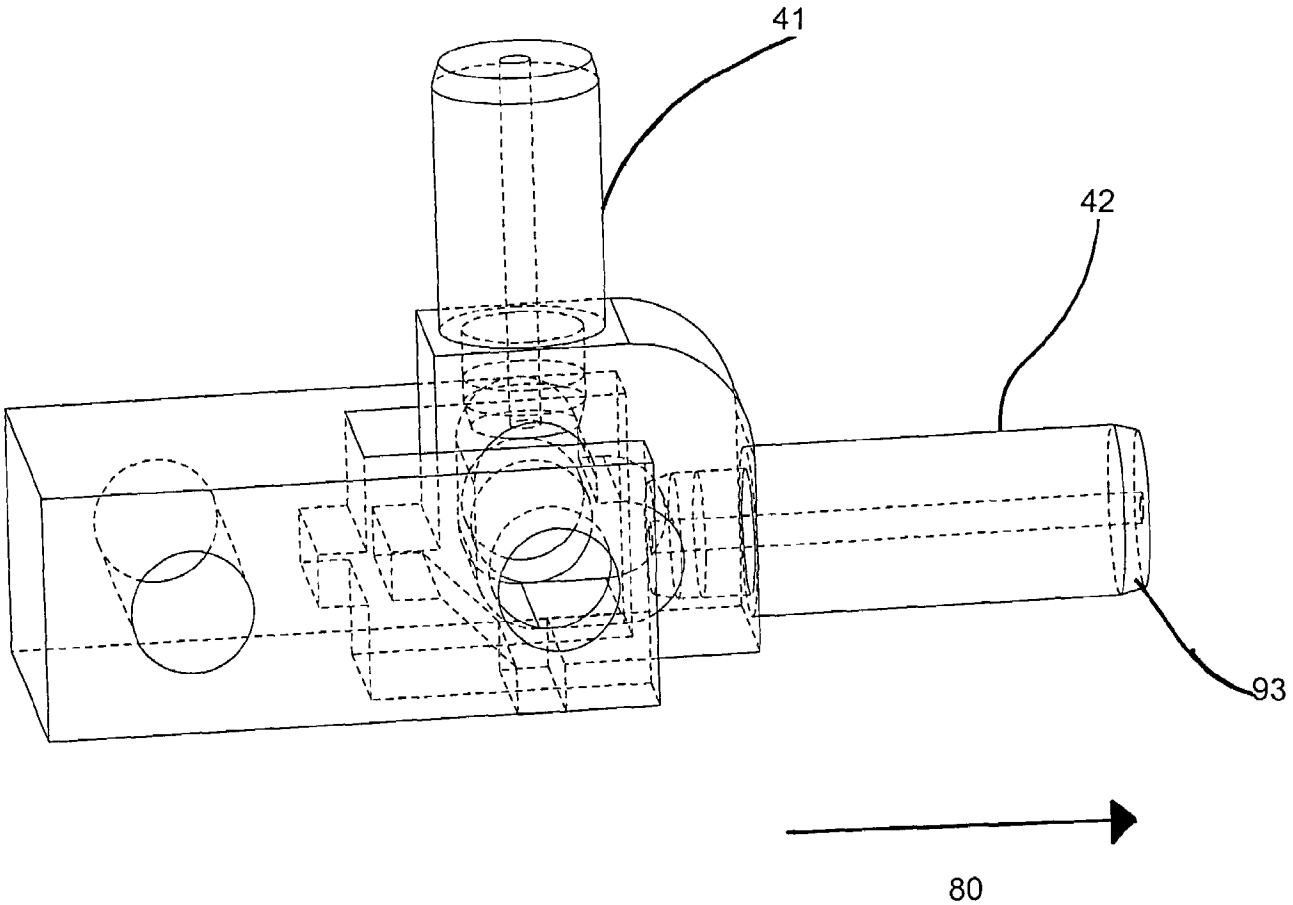
FIG. 9 shows a hidden internal view driver pin assembly removed from the tool and in an unlocked position.
Figure 10:
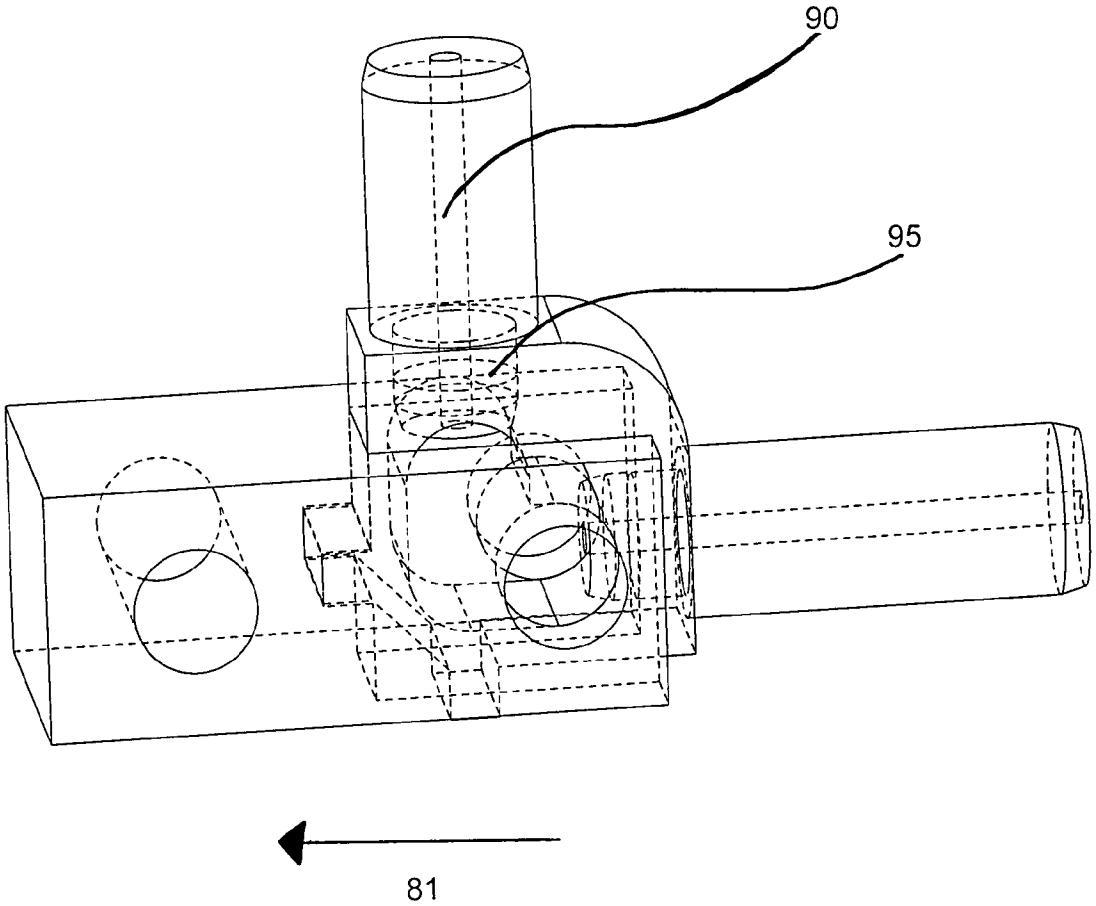
FIG. 10 shows a hidden internal view driver pin assembly removed from the tool and in a locked position.

With a driver pin assembly having a means of adjusting driver pin size within the body to change from the first driver pin 41 to second driver pin 42 the tab 66 may be slid out of the tab receiver 58. FIGS. 8-10 show driver pin assembly 40 with the direction 80 to release the tab 66, which is opposite from the direction of compression 81 to prevent unintended release or misalignment during the compression stroke. Once tab 66 is free from the receiver 58 the driver pin assembly is rotated about the protrusion 58 within groove 41 until a second driver pin locking tab 67 associated with the second driver pin position 45 is aligned properly and inserted.

When the driver pin assembly 40 is oriented so that the first driver pin 41 is in place it forms a first compression channel portion 60 adjacent the sliding head 50 for receiving a connector 200 of a first dimension formed when the driver pin assembly 40 is locked in the first driver pin position 44. A second compression channel portion 61 is formed adjacent the sliding head 50 for receiving a connector 200 of a second dimension formed when the driver pin assembly 40 is in the second driver pin position 45 as displayed in FIGS. 5-7.

Another embodiment of the multiple driver tip compression tool also according to FIGS. 1-10 comprises a body 10 having an interior 12, a top 8, a bottom 5, a first side 6 and a second side 7 each side having a guidance portion 9 therein. The body is made of any sufficiently rigid material as described above to prevent twisting during the compression of the connector.

A handle 14 is attached to the body 10, wherein the handle 14 is pivotally attached 16 to the body 10 between the first side 6 and the second side 7. The handle 14 may be raised or extended away from the body 10 to enlarge the compression chamber to insert an uncompressed connector 200. A toggle lever 70 may be affixed to the handle 14 that, when the handle is raised or lowered, in turn linearly moves a sliding head 50.

The sliding head 50 has a guidance component 54, 55, wherein the guidance component 54, 55 of the sliding head 50 is both retained and movable within the retainer or guidance portion 9 of the body 10. The guidance component 54, 55 works in conjunction with the retainer portion and they can either be male or female in that a groove or indent works in conjunction with a protrusion to ensure proper alignment of the sliding head 50 and the drivers tip 41, 42 with the connector 200.

Connected to the sliding head 50 is an adjustable driver pin assembly 40 having at least two differently dimensioned driver pins 41, 42 operatively coupled to the sliding head 50 wherein said assembly has a first driver pin position 44 and a second driver pin position 45. The driver pins 41, 42, may have different lengths and diameters from each other to correspond to different sized connectors.

The body interior 12, which may be formed by the first side 6 and the second side 7 forms a compression channel portion 60 configured to receive a first connector 42 when the driver pin assembly 40 may be in the first driver pin position 44, and a second connector 41 when the driver pin assembly 40 may be in the second driver pin position 45. A cable cradle 30 may be at the other end of the compression channel portion 60, wherein the cradle 60 accepts the force from the driver pin and may be affixed to the body 10 between the first side 6 and the second side 7.

To make the driver pin assembly 40 adjustable there may be a protruding component 52 of the sliding head 50 that works with a receiving portion 41 of the driver pin assembly 40. The receiving portions may be "L shaped" with a two driver pin option or it may be a "sideways T" with three pins installed. Another option as shown in FIG. 3 is to have a driver tip unit 40 that is removably affixed within the body 10 or to sliding head 50 for exchange with a second driver tip unit 40*b* having two different dimensioned driver tips from the first driver tip unit 40*a*.

Figure 2:
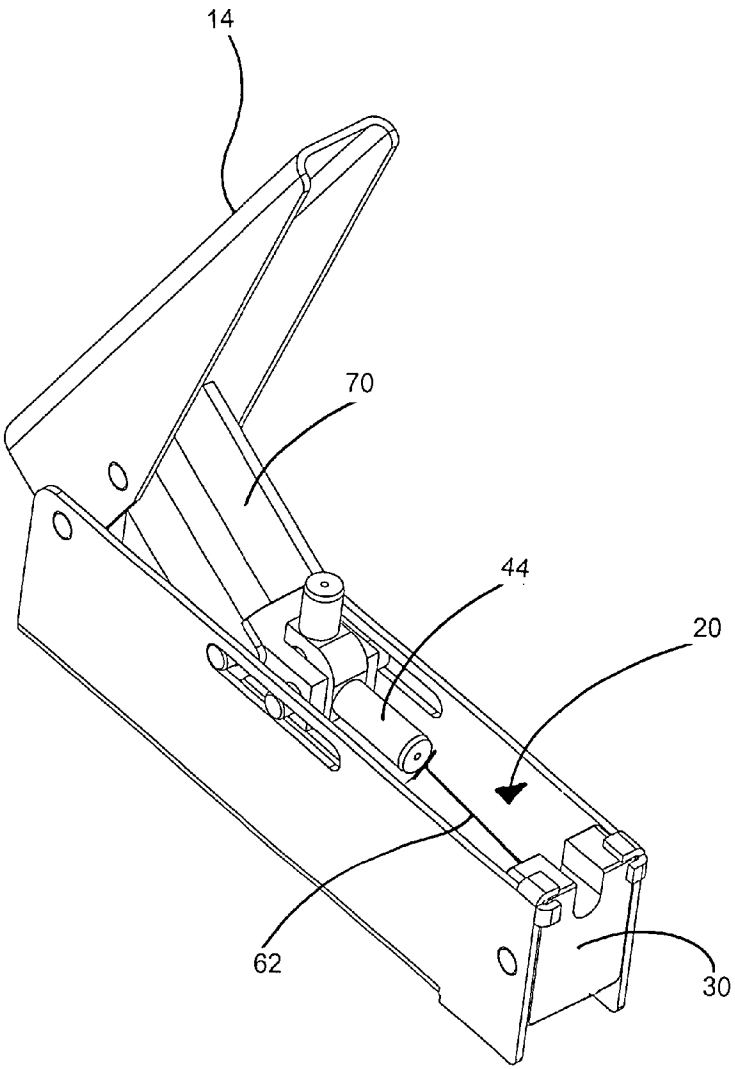
FIG. 2 shows a top view of the tool with the handle raised.
Figure 4:
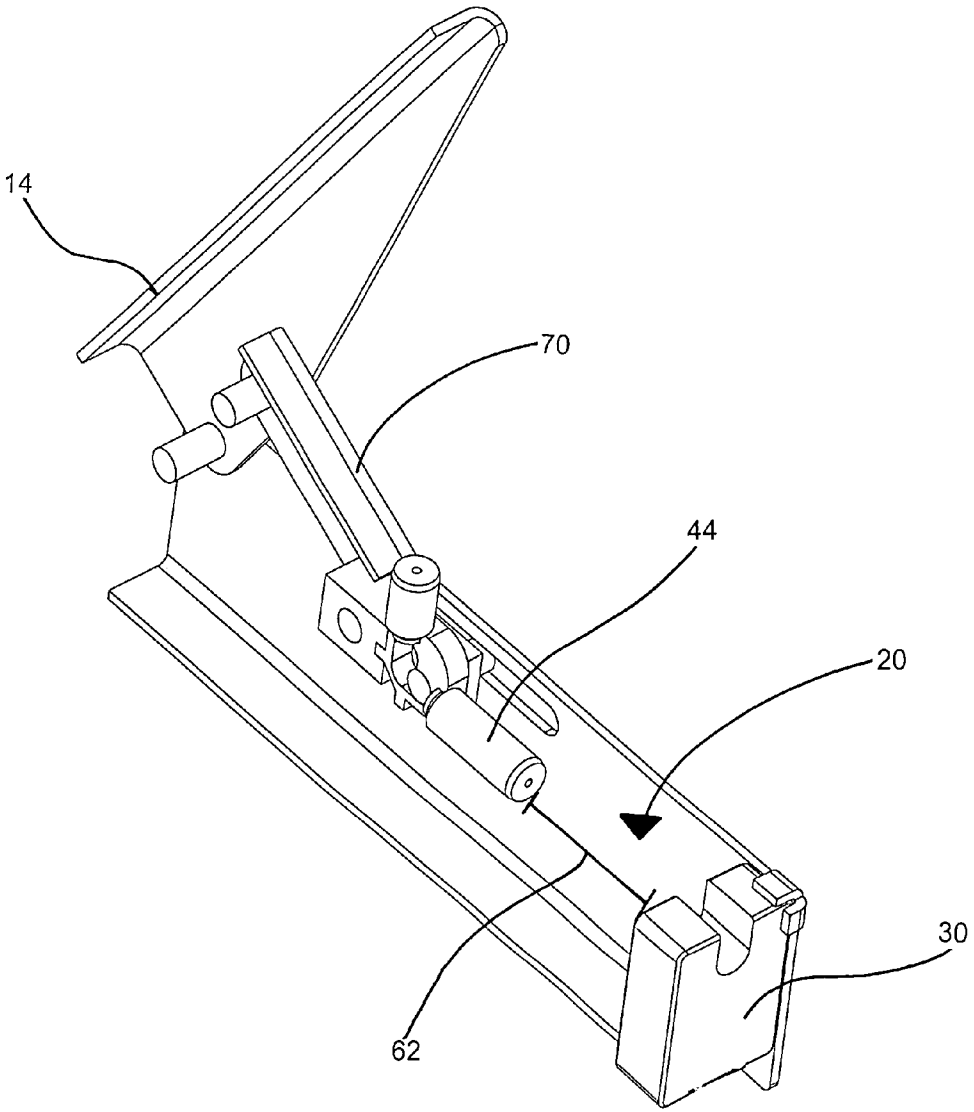
FIG. 4 shows a cutaway view of the tool with the handle raised.
Figure 5:
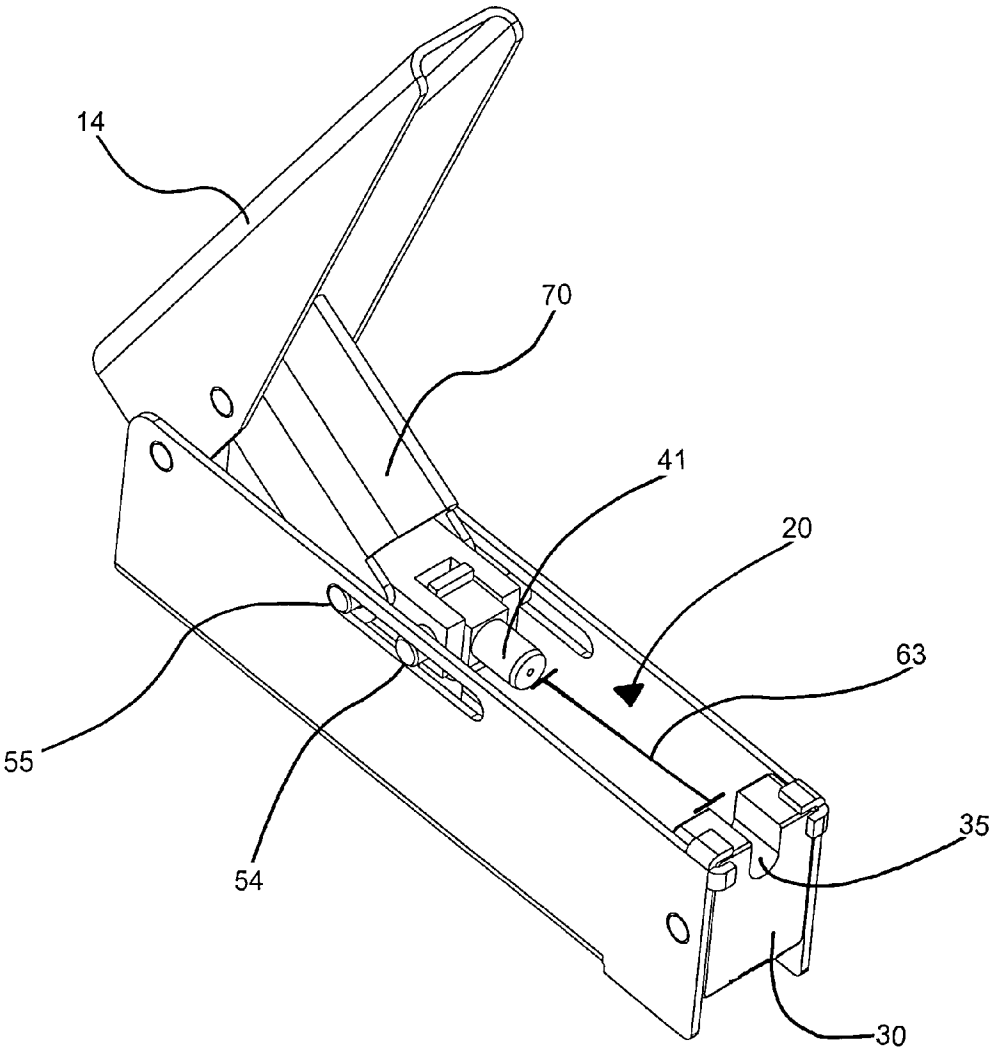
FIG. 5 shows the tool with the handle raised.
Figure 6:
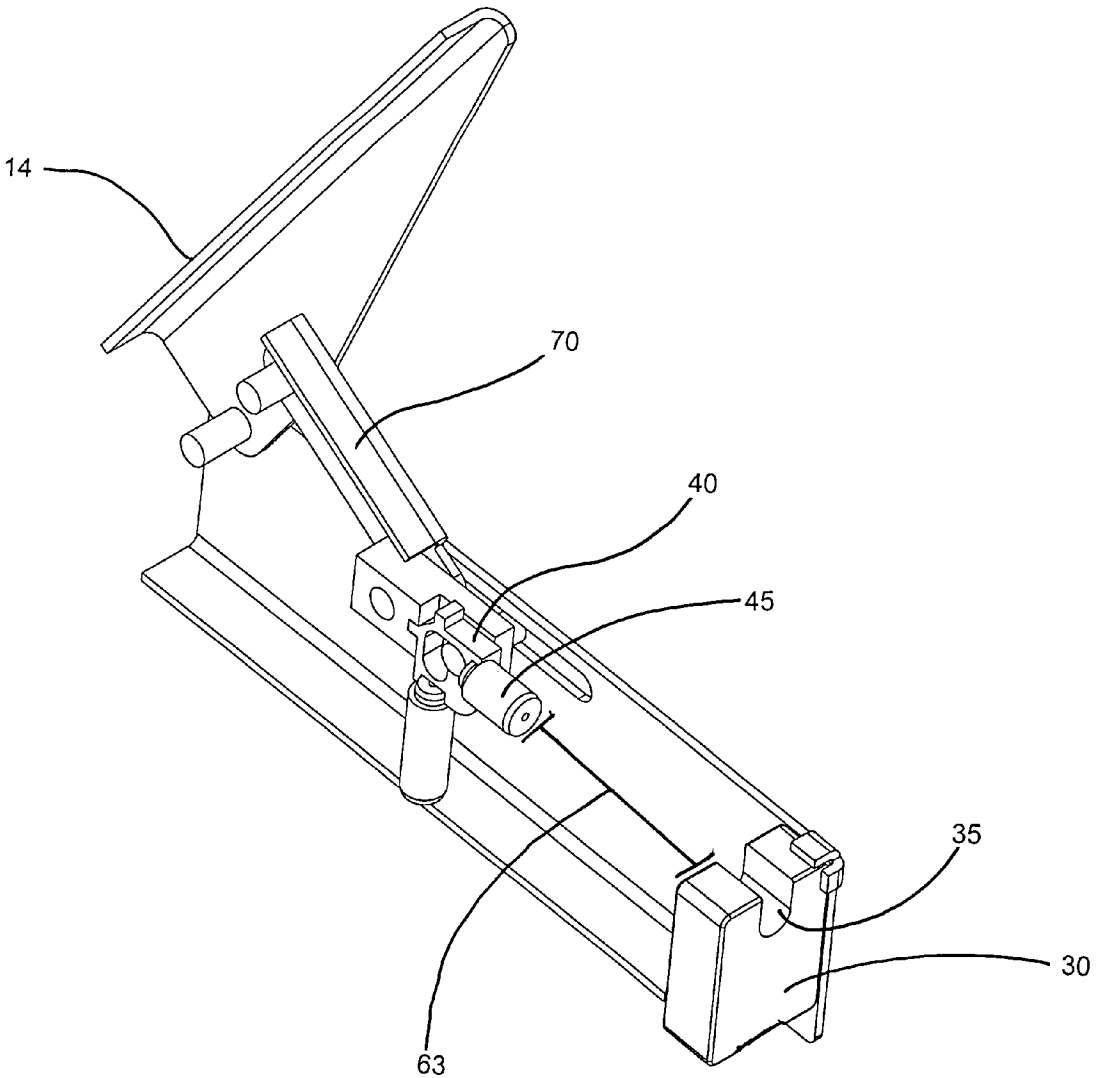
FIG. 6 shows a cutaway view of the tool with the handle raised in a different driver pin configuration.
Figure 7:
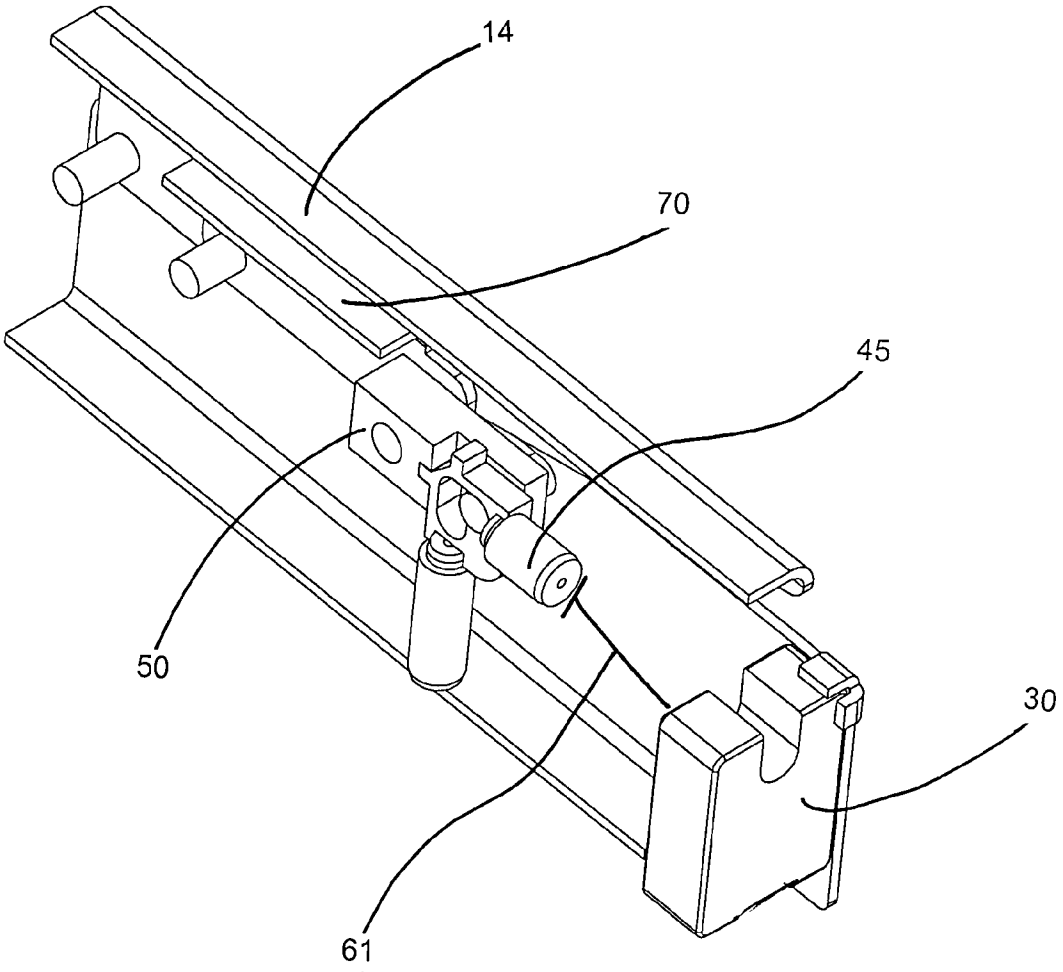
FIG. 7 shows a cutaway view of the tool with the handle lowered.

When the driver pin assembly 40 is in the first driver tip position 44, as in FIGS. 2-4, there is a first compressed length 60 that corresponds to the compression channel portion 20 adjacent the cable cradle 30. To get a second compressed length 61, as shown in FIGS. 5-7, that corresponds to the compression channel portion 20 the driver pin assembly 40 should be in the second driver tip position 45. The protruding component 52 on the sliding head 50 may be a post that retains the driver tip unit 40 rotatably and slidably attached to the sliding head 50 to allow repositioning of the driver pins.

FIGS. 2, 5 and 6 show handle 14 in a raised position, which allows the loading of the uncompressed connector 200 into the compression chamber 20 with the driver pin 41 in the second position 45. The raising of the handle 14 pulls the toggle member 70 that is hingedly and pivotally attached to both the body 10, in the retaining groove 9 and with the same member 55 the toggle member 70 is affixed to the sliding head 50, which is in turn releasably attached to a driver pin assembly 40. The uncompressed length 62, 63 is sufficient sized to allow removal after the compression of the connector.

The driver pin assembly 40 is shown removed in FIGS. 8-10 from the tool where either the individual pins 41, 42 can be removed from the driver pin assembly 40. The driver pins may be made removable and retained by such method as screw threads 95. The driver pin may be hollow or have a receiver hole 90 to prevent damage of the center electrodes of the connector or the center wire section of the cable during the compression process.

A method of affixing a cable connector to a wire comprises providing a body 10 having an interior 12, a handle 14, wherein the handle 14 is movably attached to the body 10, at least one compression chamber portion 20 within the interior 12 of the body 10 that is configured for receiving a connector 200, a cable cradle 30 having at least one cable receiving portion 35, wherein the cable cradle 30 is affixed to the body 10, an driver pin assembly 40 having at least two driver pins 41, 42 operatively coupled to the handle 14 wherein said assembly has a first driver pin position 44 and a second driver pin position 45, and at least two different dimensioned driver pins 41, 42 affixed to the driver pin assembly 40. To make a connector cable start by providing an uncompressed cable connector 200 a wire 210. Then, inserting the cable connector 200 and the wire 210 and selecting an appropriately sized driver tip 41, 42 in the body 10 that corresponds to the driver tip position 44, 45 and then rotating the driver pin assembly to the appropriate driver tip position. Once in position finish by moving the sliding head 50, which may include compressing the handle, to drive the cable connector 200 onto the wire 210 forming a connector cable 215. Then finish by removing the connector cable 215 from the body 210.

If neither of the driver pins 41, 42 are the appropriate size then it can be remedied by providing a second driver tip assembly 40*a*, wherein you are removing the first driver tip assembly 40 and inserting a second driver tip assembly 40*a* having an appropriately sized driver tip onto the sliding head 50 in the body 10.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims. The claims provide the scope of the coverage of the invention and should not be limited to the specific examples provided herein.

I claim:

1. A multiple drive pin size compression tool comprising:

a body having an interior;

a handle, wherein the handle is movably attached to the body;

at least one compression chamber portion within the interior of the body that is configured for receiving a connector;

a cable cradle having at least one cable receiving portion, wherein the cable cradle is affixed to the body;

an driver pin assembly having at least two driver pins operatively coupled to the handle wherein said assembly has a first driver pin position and a second driver pin position;

a sliding head operatively associated with the driver pin assembly, the sliding head having a protruding component that is configured to interact with the driver pin assembly and the handle;

a receiving portion within the driver pin assembly that accepts the protruding component of the sliding head; and at least two different dimensioned driver pins affixed to the driver pin assembly.

2. The tool of claim 1 further comprising:

a hinge to pivotally affixed between the handle to the body.

3. The tool of claim 1 further comprising:

a first compressed length that corresponds to the driver pin assembly being in the first driver pin position.

4. The tool of claim 1 further comprising:

a second compressed length that corresponds to the driver pin assembly being in the second driver pin position.

5. The tool of claim 1 further comprising:

a toggle lever affixed between the handle and the sliding head.

6. The tool of claim 1 further comprising:

a first driver pin locking tab operatively associated with the first driver pin position; and a tab receiver on the sliding head.

7. The tool of claim 6 further comprising:

a second driver pin locking tab associated with the second driver pin position.

8. The tool of claim 1 further comprising:

a first compression channel portion of the sliding head for receiving a connector of a first dimension formed when the driver pin assembly is in the first driver pin position.

9. The tool of claim 1 further comprising:

a second compression channel portion of the sliding head for receiving a connector of a second dimension formed when the driver pin assembly is in the second driver pin position.

10. A multiple driver tip compression tool comprising:

a body having an interior, a top, a bottom, a first side and a second side each side having a guidance portion therein;

a handle, wherein the handle is pivotally attached to the body between the first side and the second side;

a sliding head having a guidance component, wherein the guidance component of the sliding head is both retained and movable within the guidance portion of the body;

a toggle lever affixed to the handle;

a driver pin assembly having at least two differently dimensioned driver pins operatively coupled to the sliding head wherein said assembly has a first driver pin position and a second driver pin position;

an compression channel portion configured to receive a first connector when the driver pin assembly is in the first driver pin position, and a second connector when the driver pin assembly is in the second driver pin position; and, a cable cradle, wherein the cradle is affixed to the body between the first side and the second side.

11. The tool of claim 10 further comprising:

a protruding component of the sliding head.

12. The tool of claim 10 further comprising:

a receiving portion of the driver pin assembly.

13. The tool of claim 10 further comprising:

a driver tip unit that is removably affixed within the body for exchange with a second driver tip unit.

14. The tool of claim 10 further comprising:

a first compressed length that corresponds to the compression channel portion of the head when the driver pin assembly is in the first driver tip position.

15. The tool of claim 10 further comprising:

a second compressed length that corresponds to the compression channel portion of the head when the driver pin assembly is in the second driver tip position.

16. The tool of claim 10 wherein the protruding component on the sliding head is a post that retains the driver tip unit rotatably to the sliding head.

17. A multi-pin compression tool comprising:

a body, having a compression chamber therein;

a driver pin assembly having a means of adjusting driver pin size within the body to change from a first driver pin having a first size to a second driver pin having a second size; and a means of moving the first driver pin and the second driver pin in a direction of an axis of the compression chamber within the body, the means operatively associated with the driver pin assembly, wherein the driver pin is axially moved from an uncompressed position to a compressed position.

* * * * *